US008441508B2

(12) United States Patent
Taki et al.

(10) Patent No.: US 8,441,508 B2
(45) Date of Patent: May 14, 2013

(54) IMAGE ERASING APPARATUS FOR ERASING IMAGE ON SHEET WHILE CARRYING SHEET

(75) Inventors: Hiroyuki Taki, Shizuoka (JP); Isao Yahata, Shizuoka (JP); Takahiro Kawaguchi, Shizuoka (JP); Hiroyuki Taguchi, Shizuoka (JP); Hiroyuki Tsuchihashi, Shizuoka (JP); Ken Iguchi, Shizuoka (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 363 days.

(21) Appl. No.: 12/813,011

(22) Filed: Jun. 10, 2010

(65) Prior Publication Data

US 2010/0315475 A1 Dec. 16, 2010

Related U.S. Application Data

(60) Provisional application No. 61/187,187, filed on Jun. 15, 2009, provisional application No. 61/187,188, filed on Jun. 15, 2009.

(51) Int. Cl.
*B41J 2/32* (2006.01)

(52) U.S. Cl.
USPC ..... 347/179

(58) Field of Classification Search ..... 347/179; 400/695, 697, 699
See application file for complete search history.

(56) References Cited

U.S. PATENT DOCUMENTS

| | | | | |
|---|---|---|---|---|
| 2005/0151997 | A1* | 7/2005 | Murakami et al. | 358/1.16 |
| 2009/0103147 | A1* | 4/2009 | Murakami | 358/498 |
| 2010/0321740 | A1* | 12/2010 | Roof | 358/448 |
| 2010/0323287 | A1* | 12/2010 | Yahata et al. | 430/19 |

FOREIGN PATENT DOCUMENTS

| | | | |
|---|---|---|---|
| EP | 1509035 | * | 2/2005 |
| JP | 05-289576 | | 11/1993 |

* cited by examiner

*Primary Examiner* — Huan Tran
(74) *Attorney, Agent, or Firm* — Patterson & Sheridan, LLP

(57) ABSTRACT

An image erasing apparatus includes: a first carrying section carrying a recording medium; a second carrying section carrying the recording medium; a branching section branching a carrying path into the first carrying section and the second carrying section; a first erasing section erasing an image of the recording medium in the first carrying section; a second erasing section erasing the image of the recording medium in the second carrying section; a third carrying section carrying the recording medium passing through the first erasing section to the second carrying section; and a control section selecting the carrying path of the recording medium depending on an image erasing mode.

19 Claims, 11 Drawing Sheets

IMAGE ERASING APPARATUS FOR ERASING IMAGE ON SHEET WHILE CARRYING SHEET

CROSS-REFERENCE TO RELATED APPLICATION

This application is based upon and claims the benefit of priority from Provisional U.S. Applications 61/187,187 filed on Jun. 15, 2009 and 61/187,188 filed on Jun. 15, 2009, the entire contents of which are incorporated herein by reference.

FIELD

Embodiments described herein relate generally to an image erasing apparatus configured to erase an image formed on a sheet.

BACKGROUND

In recent years, to save paper resources to protect the environment, there is a need for reusing a sheet after image information formed on the sheet is used. To reuse a sheet, an image is erased by emitting light to the image on the sheet formed of erasing toner or heating the image, and a new image is then formed on the sheet from which the image is removed. Accordingly, high paper quality is required for a reuse sheet in some applications. In some applications, high paper quality is not required but there may be times when there is a desire to use the reuse sheet quickly.

Accordingly, there is a need for development of an image erasing apparatus which can properly supply a reuse sheet depending on the situation where a sheet is used.

DETAILED DESCRIPTION

According to an embodiment, an image erasing apparatus includes: a first carrying section carrying a recording medium; a second carrying section carrying the recording medium; a branching section branching a carrying path into the first carrying section and the second carrying section; a first erasing section erasing an image of the recording medium in the first carrying section; a second erasing section erasing the image of the recording medium in the second carrying section; a third carrying section carrying the recording medium passing through the first erasing section to the second carrying section; and a control section selecting the carrying path of the recording medium depending on an image erasing mode.

First Embodiment

Figure 1:
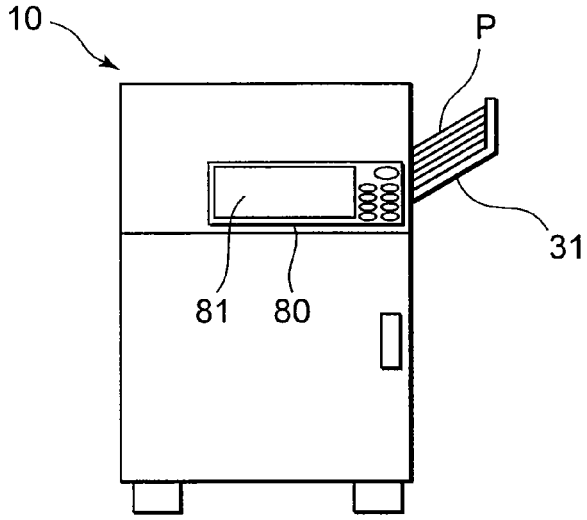
FIG. 1 is a front view schematically illustrating an image erasing apparatus according to a first embodiment.
Figure 2:
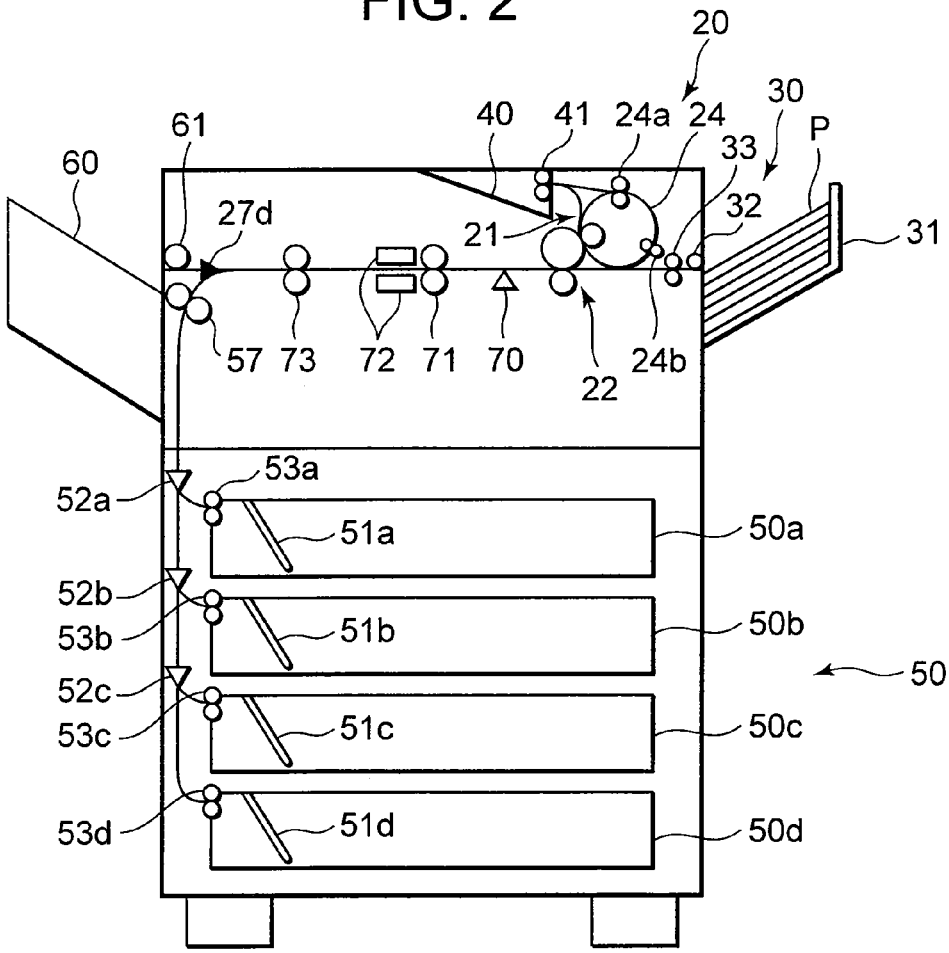
FIG. 2 is a diagram schematically illustrating a configuration of the image erasing apparatus according to the first embodiment.

Hereinafter, a first embodiment will be described. As shown in FIGS. 1 and 2, an image erasing apparatus 10 according to a first embodiment includes an erasing mechanism 20, a supply section 30 supplying a sheet P as a recording medium, which an image is not erased, to the erasing mechanism 20, and a paper discharge tray 40 as a first placing section and a piling cassette 50 as a second placing section on which the sheet P which the image is erased by the erasing mechanism 20 is placed. The image erasing apparatus 10 includes a rejection box 60 as a rejection section recovering the sheet P which the image is erased by the erasing mechanism 20 when the sheet is not suitable for reuse.

The image erasing apparatus 10 includes a control panel 80 as an instruction unit on the front surface thereof. The supply section 30 includes a pickup roller 32 picking up sheets Pin a supply cassette 31 as a support section and a separation roller pair 33 feeding the uppermost sheet of the picked-up sheets P.

Figure 3:
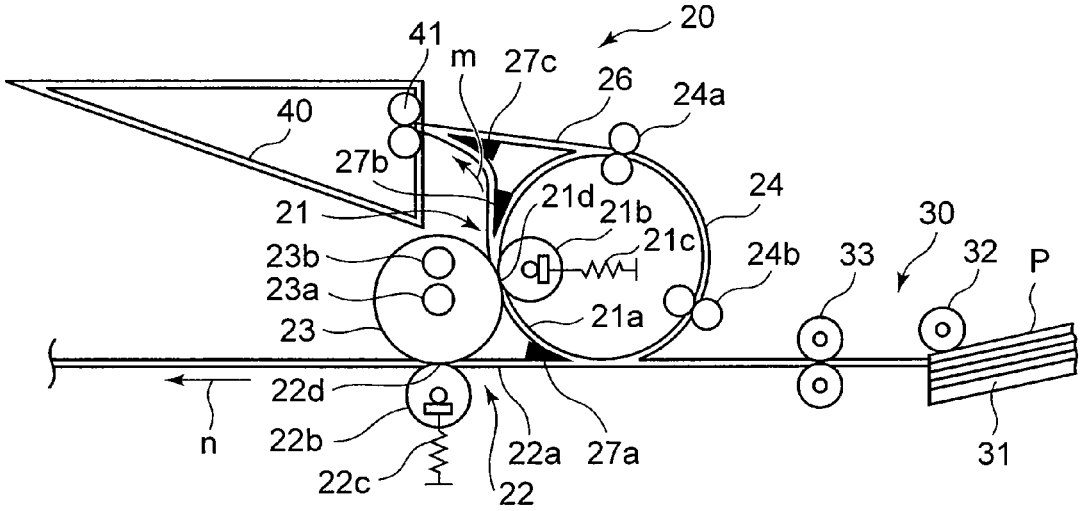
FIG. 3 is a diagram schematically illustrating a partial configuration of an erasing mechanism according to the first embodiment.

The erasing mechanism 20 includes a first erasing mechanism 21 and a second erasing mechanism 22 as shown in FIG. 3. The first erasing mechanism 21 serves as a first carrying section and includes a first guide 21*a* guiding the sheet P to the discharge roller pair 41. The second erasing mechanism 22 serves as a second carrying section and includes a second guide 22*a* guiding the sheet P to the piling cassette 50 or the rejection box 60. The erasing mechanism 20 includes a heat roller 23 used as an endless first heating member and an endless second heating member in a region covering the first guide 21*a* and the second guide 22*a*.

The first erasing mechanism 21 includes a first press roller 21*b* pressed on the heat roller 23 to be rotationally driven. The heat roller 23 and the first press roller 21*b* constitute a first erasing section. The second erasing mechanism 22 includes a second press roller 22*b* pressed on the heat roller 23 to be rotationally driven. The heat roller 23 and the second press roller 22*b* constitute a second erasing section.

The heat roller 23 has a surface layer formed of fluorine resin, for example, around an aluminum roller with a thickness of 0.8 mm. The first press roller 21*b* and the second press roller 22*b* have the same structure and have an elastic surface layer formed of silicon rubber or the like, for example, around a steel roller.

The heat roller 23 includes a center lamp 23*a* and side lamps 23*b* on both sides of the center lamp 23*a* in a hollow portion. The length of the center lamp 23*a* is equal to JIS standard A4-R size as 210 mm width, for example. The total length of the center lamp 23*a* and the side lamps 23*b* on both sides of the center lamp 23*a* covers, JIS standard A3-R size as 297 mm width, for example.

The first press roller 21*b* presses and contacts the heat roller 23 by the use of a first press mechanism 21*c* to form a nip 21*d* in cooperation with the heat roller 23. The first erasing mechanism 21 heats and presses the sheet P to erase the image of the sheet P while nipping and carrying the sheet P passing through the first guide 21*a* in the direction of arrow m. The sheet P is heated and pressed by the nip 21*d* to smooth the creases of the sheet P.

The second press roller 22*b* presses and contacts the heat roller 23 by the use of a second press mechanism 22*c* to form a nip 22*d* in cooperation with the heat roller 23. The second erasing mechanism 22 heats and presses the sheet P to erase the image of the sheet P while nipping and carrying the sheet P passing through the second guide 22*a* in the direction of arrow n. The sheet P is heated and pressed by the nip 22*d* to smooth the creases of the sheet P.

The erasing mechanism 20 includes a third guide 24 as a third carrying section carrying the sheet P passing through the nip 21*d* to the second guide 22*a* and a fourth guide 26 guiding the sheet P switched back by the discharge roller pair 41 to the third guide 24. The third guide 24 includes guide roller pairs 24*a* and 24*b*.

The erasing mechanism 20 includes a first flapper 27*a* as a branching section switching the traveling direction of the sheet P traveling from the separation roller 33 or the sheet P traveling through the third guide 24 to the first guide 21*a* or the second guide 22*a*. The erasing mechanism 20 includes a second flapper 27*b* the traveling direction of the sheet P passing through the nip 21*d* to the paper discharge tray 40 or the third guide 24. The erasing mechanism 20 includes a third flapper 27*c* guiding the sheet P switched back by the discharge roller pair 41 to the fourth guide 26.

The erasing mechanism 20 includes a size sensor 70, a first carrying roller pair 71, a scanner 72 reading both sides of the sheet P as a detecting section, and a second carrying roller pair 73 along the second guide 22*a*. The erasing mechanism 20 includes a fourth flapper 27*d* switching the traveling direction of the sheet passing through the second guide 22*a* to the cassette roller pair 57 or the rejection roller 61.

Figure 4:
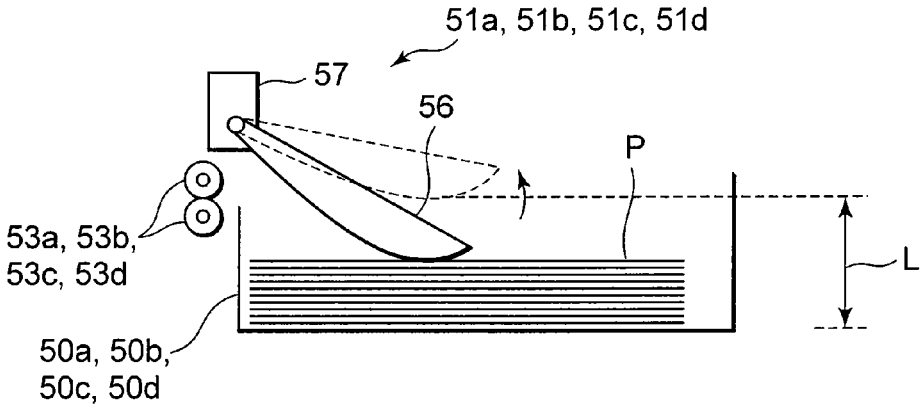
FIG. 4 is a schematic explanatory view illustrating a fullness detecting sensor according to the first embodiment.

The piling cassette 50 includes first to fourth cassettes 50*a* to 50*d*. The first to fourth cassettes 50*a* to 50*d* have the same structure and include fullness detecting sensors 51*a* to 51*d*, respectively. The fullness detecting sensors 51*a* to 51*d* a fullness detect section have the same structure and sense the angle of the actuator 56 by converting the angle into a voltage variation of a magnetic sensor 57 as shown in FIG. 4. For example, the first cassette 50*a* piles JIS standard A4-size sheets in (Clear Finish 1) to be described later, the second cassette 50*b* piles sheets of other sizes in (Clear Finish 1), the third cassette 50*c* piles JIS standard A4-size sheets in (Simple Finish2), and the fourth cassette 50*d* piles sheets of other sizes in (Simple Finish2). Alternatively, the sheets P are piled from the uppermost cassette 50*n* out of the first to fourth cassettes 50*a* to 50*d* regardless of the sizes of the sheets P, and the sheets P are piled on the next cassette when the uppermost cassette 50*n* is full.

The cassette flappers 52*a* to 52*c* branch the sheets P from the cassette roller pair 57 and the piling roller pairs 53*a* to 53*d* pile the sheets P on the first to fourth cassettes 50*a* to 50*d* respectivery.

Figure 5:
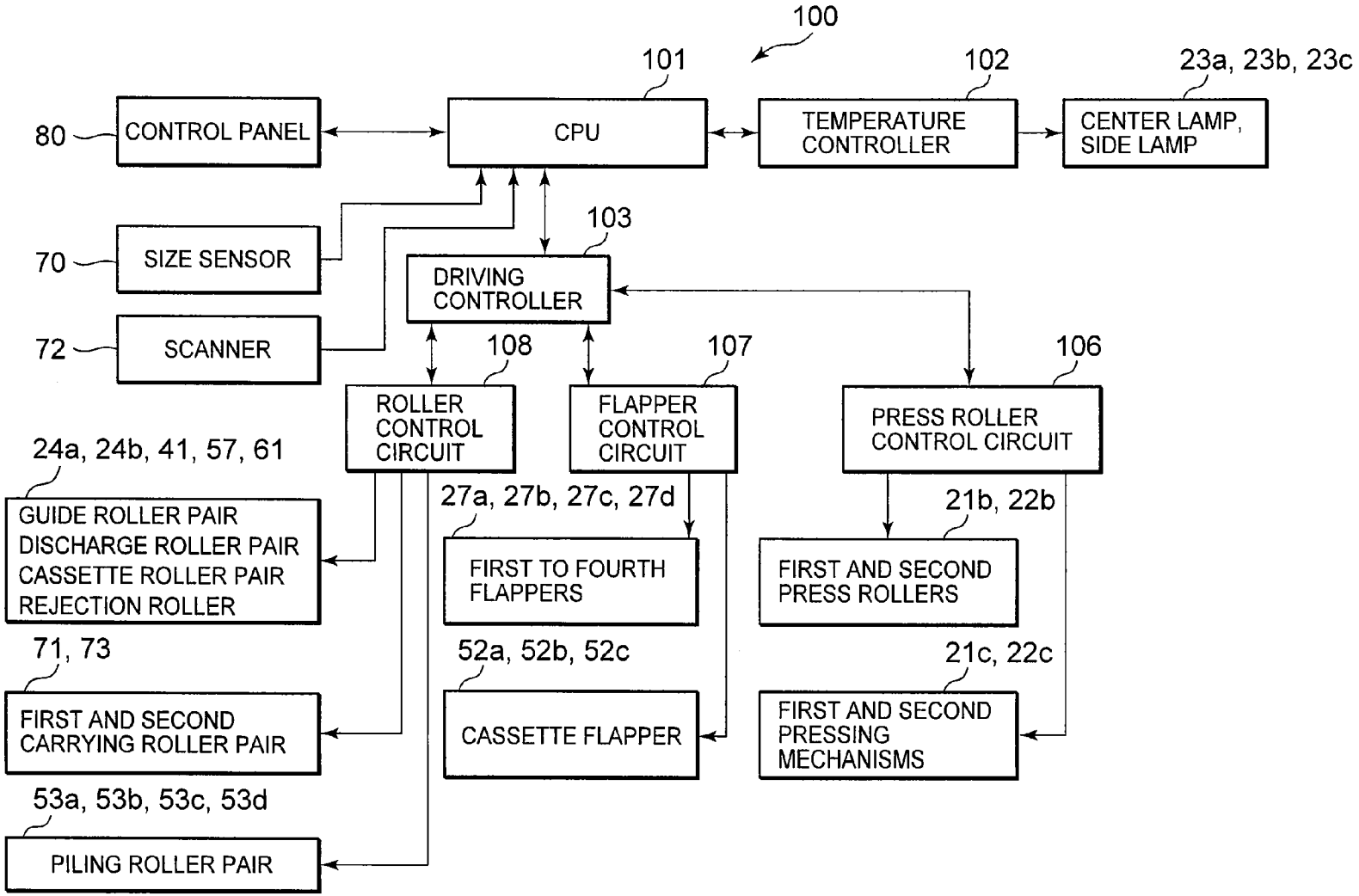
FIG. 5 is a block diagram schematically illustrating a control system according to the first embodiment.

As shown in FIG. 5, a CPU 101 controlling the entire image erasing apparatus 10 of a control system 100 controls a temperature controller 102 controlling the center lamp 23*a* and the side lamps 23*b* and a driving controller 103 as a control section. The driving controller 103 controls a press roller control circuit 106, a flapper control circuit 107, and a roller control circuit 108.

The press roller control circuit 106 controls the driving of the first and second press rollers 21*b* and 22*b* and the driving of the first and second press mechanisms 21*c* and 22*c*. The flapper control circuit 107 controls the driving of the first to fourth flappers 27*a* to 27*d* and the cassette flappers 52*a* to 52*c*. The roller control circuit 108 controls the driving of the guide roller pairs 24*a* and 24*b*, the discharge roller pair 41, the cassette roller pair 57, the first and second carrying roller pairs 71 and 73, the piling roller pairs 53*a* to 53*d*, and the rejection roller 61.

Figure 6:
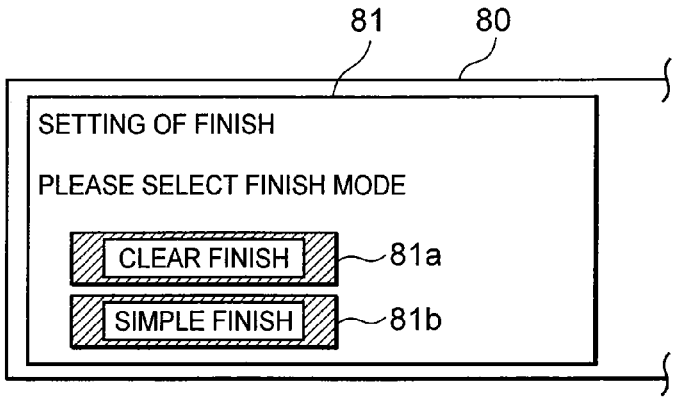
FIG. 6 is a plan view schematically illustrating an example of a display on a display panel according to the first embodiment.

The CPU 101 controls the temperature controller 102 and the driving controller 103 in accordance with the sensing result of the size sensor 70 and the scanner 72 and an instruction input from the control panel 80. By the use of the control panel 80, a user instructs the setting of an erasing finish as an image erasing mode in the image erasing apparatus 10, for example, as shown in FIG. 6. The user selects and sets, for example, (Clear Finish) 81*a* or (Simple Finish) 81*b* displayed on the display panel 81.

The image erasing apparatus 10 erases the image of the sheet P in the supply cassette 31 in the image erasing mode instructed from the control panel 80 when the erasing instruction is given from the control panel 80.

Mode of (Simple Finish 1)

In (Simple Finish 1), an image of a sheet P is erased once by the use of the first erasing mechanism 21 and discharged to the paper discharge tray 40. The user sets, for example, the size of the sheet P and (Simple Finish 1) by the use of the control panel 80. The CPU 101 controls the temperature controller 102 and the driving controller 103. When the sheet width is less than the size of JIS standard A4-R, the temperature controller 102 turns on only the center lamp 23*a*. When the sheet width is equal to or greater than the size of JIS standard A4-R, the temperature controller 102 turns on the center lamp 23*a* and the side lamps 23*b*.

Figure 7:
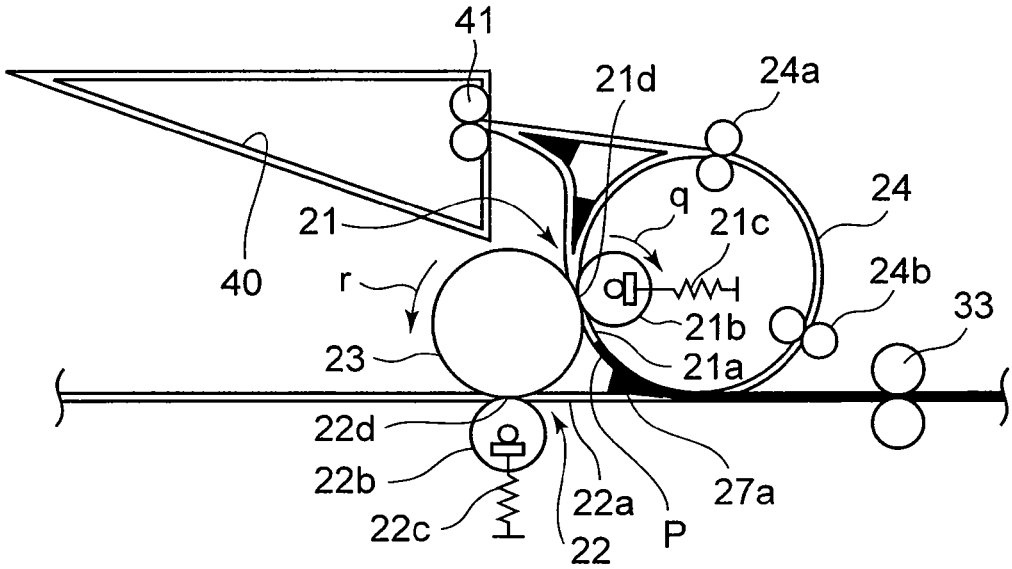
FIG. 7 is a schematic explanatory view illustrating the branching of a sheet at a first flapper in (Simple Finish 1) according to the first embodiment.

Under the control of the driving controller 103, the sheets P picked up from the supply cassette 31 by the pickup roller 32 are separated by the use of the separation roller pair 33 and the separated sheet is carried to the first flapper 27*a*. The first flapper 27*a* guides the sheet P to the first guide 21*a* as shown in FIG. 7. The first press mechanism 21*c* presses the first press roller 21*b* rotating in the direction of arrow q on the heat roller 23 to form the nip 21*d* between the first press roller 21*b* and the heat roller 23. The heat roller 23 rotates in the direction of arrow r with the rotation of the first press roller 21*b*.

Figure 8:
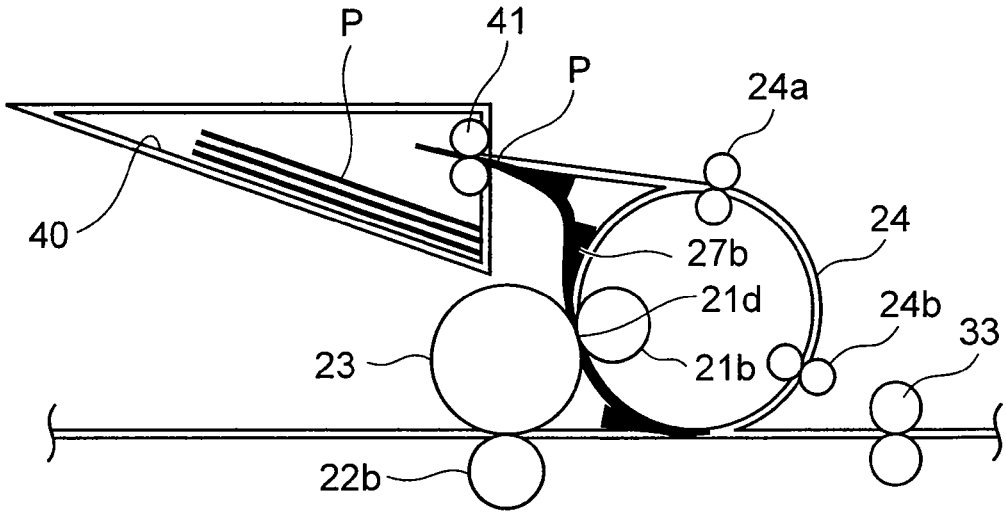
FIG. 8 is a schematic explanatory view illustrating the discharging of an erased sheet in (Simple Finish 1) according to the first embodiment.

The first press roller 21*b* and the heat roller 23 heat and press the sheet P from the side contacting the heat roller 23 by the use of the nip 21*d* to erase the image of the sheet P. As shown in FIG. 8, the second flapper 27*b* guides the sheet P to the paper discharge tray 40 and the discharge roller pair 41 discharges the sheet P. The user quickly picks up the sheet P from the paper discharge tray 40 and uses the picked-up sheet, for example, for new printing.

In (Simple Finish 1), the erasing speed is high and thus the user can quickly pick up the sheet P on the paper discharge tray 40 as is without opening and closing any cassette. Accordingly, it is possible to easily obtain the reuse sheet.

Mode of (Simple Finish2)

In (Simple Finish2), the image of the sheet P is erased once by the use of the second erasing mechanism 22 and the resultant sheet is received in the piling cassette 50. The user sets, for example, (Simple Finish2) by the use of the control panel 80. The CPU 101 controls the temperature controller 102 and the driving controller 103. The temperature controller 102 turns on the center lamp 23*a* and the side lamps 23*b*.

Figure 9:
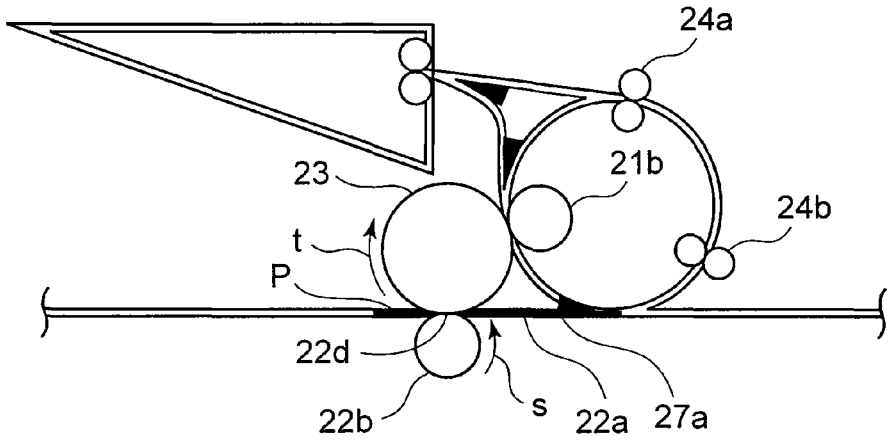
FIG. 9 is a schematic explanatory view illustrating the branching of a sheet at the first flapper in (Simple Finish2) according to the first embodiment.

Under the control of the driving controller 103, the first flapper 27*a* guides the sheets P separated by the separation roller pair 33 to the second guide 22*a* as shown in FIG. 9. The second press mechanism 22*c* presses the second press roller 22*b* rotating in the direction of arrow on the heat roller 23 to form the nip 22*d* between the second press roller 22*b* and the heat roller 23. The heat roller 23 rotates in the direction of arrow t with the rotation of the second press roller 22*b*.

The second press roller 22*b* and the heat roller 23 heat and press the sheet P from the side contacting the heat roller 23 in the nip 22*d* to erase the image of the sheet P. On the second guide 22*a*, the size of the sheet P is sensed by the use of the size sensor 70 and both sides of the sheet P are read by the use of the scanner 72. The CPU 101 selects a cassette on which the sheet P should be piled on the basis of the sensing result of the size sensor 70. The CPU 101 determines whether the sheet can be reused on the basis of the sensing result of the scanner 72.

Figure 10:
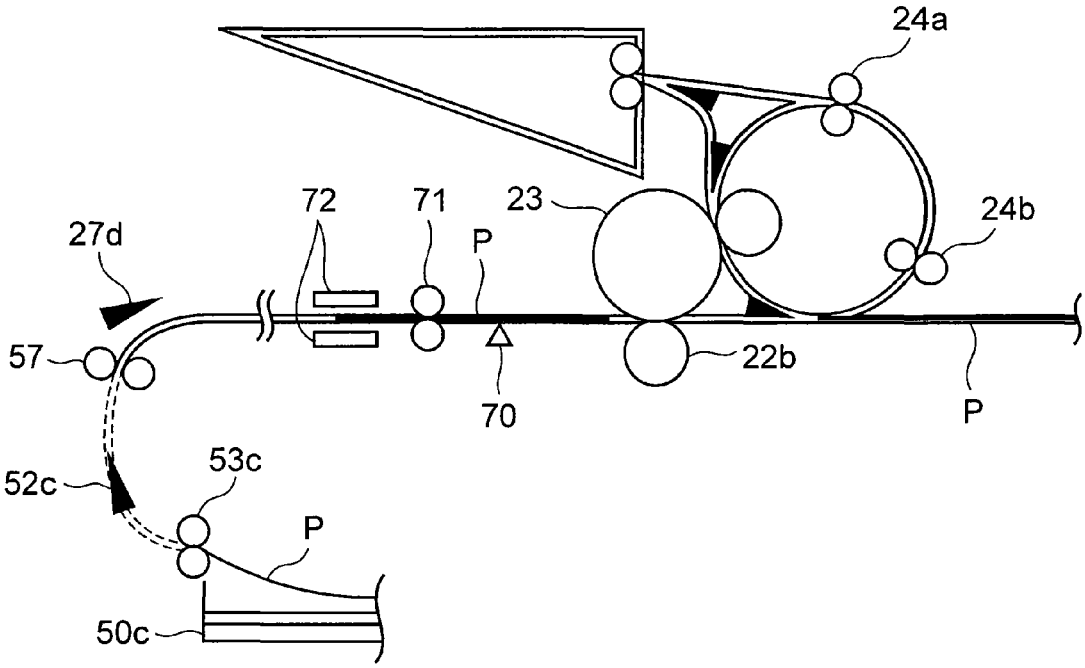
FIG. 10 is a schematic explanatory view illustrating the piling of sheets in (Simple Finish2) according to the first embodiment.

For example, when the CPU 101 determines that the sheet P has the A4 size and can be reused, the fourth flapper 27*d* and the cassette flapper 52*c* guide the sheet P to the third cassette 50*c* and the piling roller pair 53*c* piles the sheet P on the third cassette 50*c*, as shown in FIG. 10. For example, when the CPU 101 determines that the sheet P has a size other than the A4 size and can be reused, the fourth flapper 27*d* and the cassette flapper 52*c* guide the sheet P to the fourth cassette 50*d* and the piling roller pair 53*d* piles the sheet P on the fourth cassette 50*d*.

For example, when an image remains on the sheet or the sheet is damaged and thus the CPU 101 determines that the sheet P cannot be reused, the fourth flapper 27*d* guides the sheet P to the rejection box 60 and the rejection roller 61 discharges the sheet P to the rejection box 60. The user picks up the sheet P from the third cassette 50*c* or the fourth cassette 50*d* and reuses the picked-up sheet.

In (Simple Finish2), when the erasing speed is high and for example, the number of sheets is great, it is possible to collect the reuse sheets on the piling cassette 50.

Mode of (Clear Finish 1)

In (Clear Finish 1), the image of a sheet P is erased by the use of the first erasing mechanism 21 and is erased by the second erasing mechanism 22, and the resultant sheet is received in the piling cassette 50. The user sets, for example, (Clear Finish 1) by the use of the control panel 80. The CPU 101 controls the temperature controller 102 and the driving controller 103. The temperature controller 102 turns on the center lamp 23*a* and the side lamps 23*b*.

Figure 11:
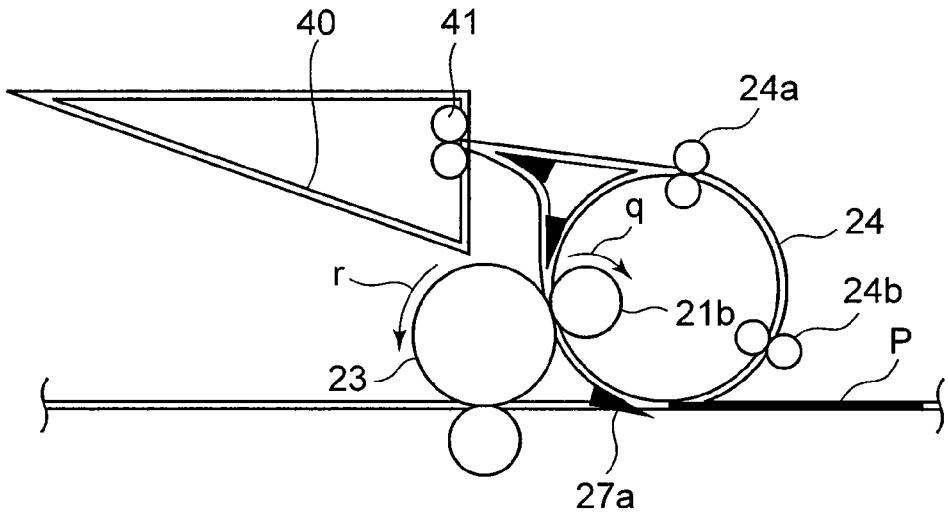
FIG. 11 is a schematic explanatory view illustrating the branching of a sheet at the first flapper in (Clear Finish 1) according to the first embodiment.

Under the control of the driving controller 103, the first flapper 27*a* guides the sheet P to the first guide 21*a*, as shown in FIG. 11. The first press mechanism 21*c* presses the first press roller 21*b* rotating in the direction of arrow q against the heat roller 23. In the nip 21*d* between the first press roller 21*b* and the heat roller 23 rotating in the direction of arrow r with the rotation of the first press roller 21*b*, the first side of the sheet P is brought in contact with the heat roller 23 and the sheet P is heated and pressed, thereby erasing the image of the sheet P.

Figure 12:
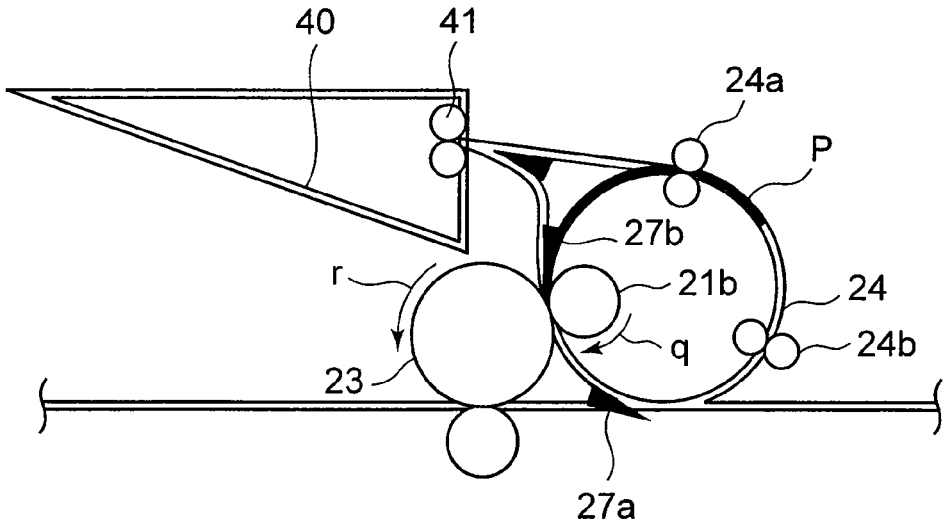
FIG. 12 is a schematic explanatory view illustrating the branching of a sheet at a second flapper in (Clear Finish 1) according to the first embodiment.
Figure 13:
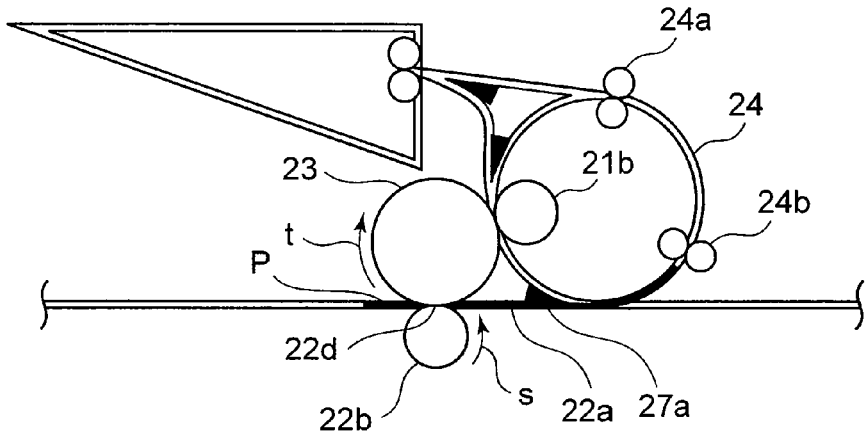
FIG. 13 is a schematic explanatory view illustrating the branching of a sheet for a second erasing mechanism in (Clear Finish 1) according to the first embodiment.

As shown in FIG. 12, the second flapper 27*b* guides the sheet P to the third guide 24. Then, as shown in FIG. 13, the first flapper 27*a* guides the sheet P traveling along the third guide 24 to the second guide 22*a*. In the first erasing mechanism 21, when the trailing end of the sheet P passes through the nip 21*d*, the first press mechanism 21*c* is released to separate the first press roller 21*b* from the heat roller 23.

In the second erasing mechanism 22, the second press mechanism 22*c* presses the second press roller 22*b* rotating in the direction of arrow s against the heat roller 23.

In the nip 22*d* between the second press roller 22*b* and the heat roller 23 rotating in the direction of arrow t with the rotation of the second press roller 22*b*, the second side of the sheet P is brought in contact with the heat roller 23 and the sheet P is heated and pressed, thereby erasing the image of the sheet P.

Both sides of the sheet P are heated by the first erasing mechanism 21 and the second erasing mechanism 22 to satisfactorily erase the image of the sheet P. The sheet P is pressed twice by the first erasing mechanism 21 and the second erasing mechanism 22 to satisfactorily remove the creases of the sheet P. The size sensor 70 senses the size of the sheet P passing through the nip 22*d* and the scanner 72 reads both sides of the sheet P. The CPU 101 selects a cassette on which the sheet P should be piled on the basis of the sensing result of the size sensor 70. The CPU 101 determines whether the sheet can be reused on the basis of the sensing result of the scanner 72.

Figure 14:
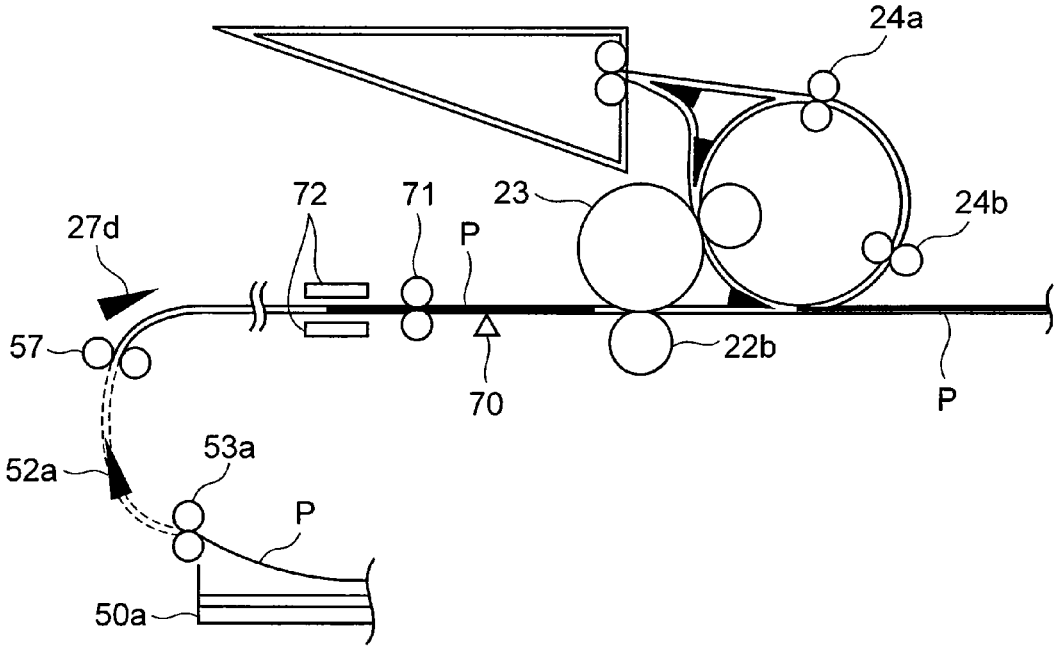
FIG. 14 is a schematic explanatory view illustrating the piling of sheets in (Clear Finish 1) according to the first embodiment.

For example, when the CPU 101 determines that the sheet P has the A4 size and can be reused, the fourth flapper 27*d* and the cassette flapper 52*a* guide the sheet P to the first cassette 50*a* and the piling roller pair 53*a* piles the sheet P on the first cassette 50*a*, as shown in FIG. 14. For example, when the CPU 101 determines that the sheet P has a size other than the A4 size and can be reused, the fourth flapper 27*d* and the cassette flapper 52*b* guide the sheet P to the second cassette 50*b* and the piling roller pair 53*b* piles the sheet P on the second cassette 50*b*.

For example, when the CPU 101 determines that the sheet P cannot be reused, the fourth flapper 27*d* guides the sheet P to the rejection box 60 and the rejection roller 61 discharges the sheet P to the rejection box 60. The user picks up the sheet P from the first cassette 50*a* or the second cassette 50*b* and reuses the picked-up sheet.

In (Clear Finish 1), the erasing time is elongated, but the finish is clear, thereby obtaining a reuse sheet with high quality.

Mode of (Clear Finish 2)

In (Clear Finish 2), the image of a sheet P is erased twice by the use of the first erasing mechanism 21 and the resultant sheet is discharged to the paper discharge tray 40. The user sets, for example, the size of the sheet P and (Clear Finish 2) by the use of the control panel 80. The CPU 101 controls the temperature controller 102 and the driving controller 103. The temperature controller 102 turns on only the center lamp 23*a* when the sheet width is less than the size of JIS standard A4-R, and turns on the center lamp 23*a* and the side lamps 23*b* when the sheet width is equal to or greater than the size of JIS standard A4-R.

Figure 15:
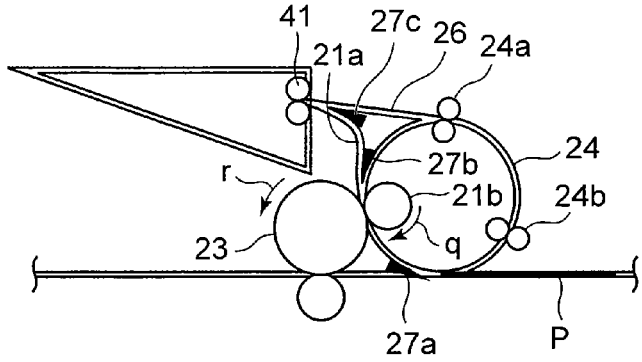
FIG. 15 is a schematic explanatory view illustrating the branching of a sheet at the first flapper in (Clear Finish 2) according to the first embodiment.

Under the control of the driving controller 103, the first flapper 27*a* guides the sheet P to the first guide 21*a*, as shown in FIG. 15. The first side of the sheet P passing through the nip 21*d* between the first press roller 21*b* and the heat roller 23 is brought in contact with the heat roller 23 to heat and press the sheet P, thereby erasing the image of the sheet P.

Figure 16:
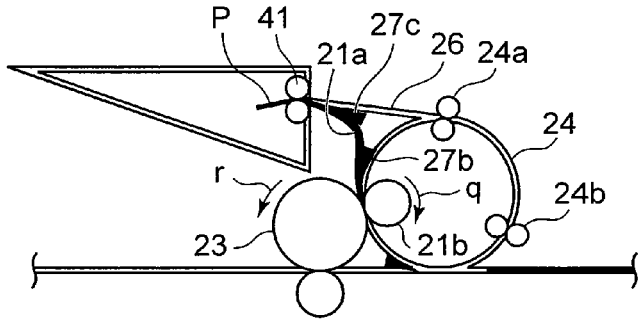
FIG. 16 is a schematic explanatory view illustrating the branching of a sheet at the second flapper in (Clear Finish 2) according to the first embodiment.
Figure 17:
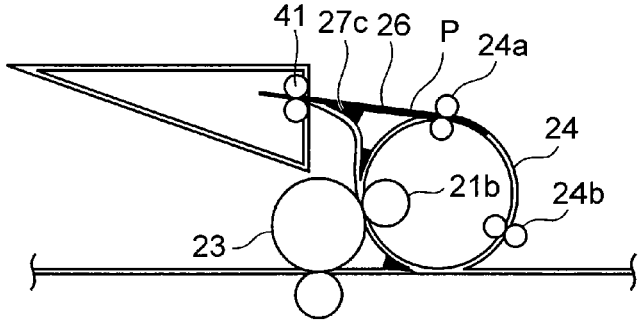
FIG. 17 is a schematic explanatory view illustrating the switch-back of a sheet in (Clear Finish 2) according to the first embodiment.

As shown in FIG. 16, the second flapper 27*b* guides the sheet P to the paper discharge tray 40 and the discharge roller pair 41 carries the sheet P to the paper discharge tray. When the trailing end of the sheet P passes through the third flapper 27*c*, the discharge roller pair 41 is made to reversely rotate. As shown in FIG. 17, the third flapper 27*c* guides the switched-back sheet P to the third guide 24 via the fourth guide 26.

Figure 18:
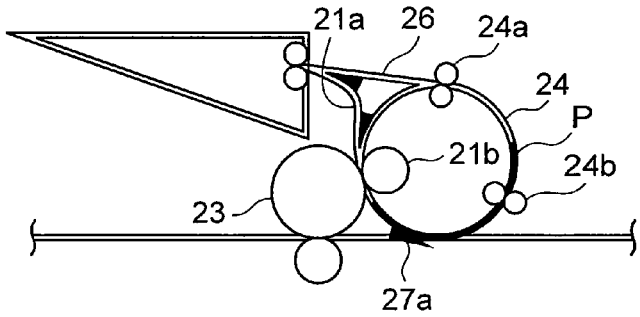
FIG. 18 is a schematic explanatory view illustrating the second erasing of a sheet in (Clear Finish 2) according to the first embodiment.

The first flapper 27*a* guides traveling along the third guide 24 to the first guide 21*a* again. As shown in FIG. 18, the second side of the sheet P switched back, reversed, and passing through the nip 21*d* again is brought in contact with the heat roller 23 to heat and press the sheet P, thereby erasing the image of the sheet P. The second flapper 27*b* guides the sheet P to the paper discharge tray 40 and the discharge roller pair 41 discharges the sheet P to the paper discharge tray 40.

The first side of the sheet P is brought in contact with the heat roller 23 in the nip 21*d*, the image of the sheet P is erased, the sheet P is then switched back, and the second side of the sheet P is brought in contact with the heat roller 23 in the nip 21*d* again, thereby erasing the image of the sheet. Both sides of the sheet P are brought in contact with the heat roller 23 and the images on the sheet P are satisfactorily erased. The nip 21*d* satisfactorily removes the creases of the sheet P by pressing the sheet P twice. The user can pick up the sheet P from the paper discharge tray 40 quickly and can use the picked-up sheet in new printing.

In (Clear Finish 2), the erasing time is elongated, but the finish is clear, thereby obtaining a reuse sheet with high quality. The user can pick up a sheet P on the paper discharge tray 40 at once without opening or closing a cassette. That is, it is possible to obtain a reuse sheet with high quality in the site.

In (Clear Finish 1) or (Clear Finish 2), when the sheet has such a size that the trailing edge of the sheet P is not separated from the nip 21*d* until the lead edge of the sheet P passing through the nip 21*d* turns once the third guide 24 and reaches the nip 21*d* again, for example, the sheet P is switched back by the discharge roller pair 41 and is guided to the third guide 24 via the fourth guide 26. Without damaging the decrease in size of the image erasing apparatus, it is possible to obtain a longitudinal reuse sheet in (Clear Finish 1) or (Clear Finish 2).

According to the first embodiment, it is possible to obtain a reuse sheet at a high speed depending on the user's requirement. It is also possible to obtain a reuse sheet with high quality depending on the user's requirement. It is also possible to easily take out a reuse sheet depending on the user's requirement.

Second Embodiment

A second embodiment will be described. The second embodiment is different from the first embodiment, in that it includes plural supply sections. In the second embodiment, the same elements as described in the first embodiment are referenced by the same reference numerals and signs and the detailed description is not repeated.

Figure 19:
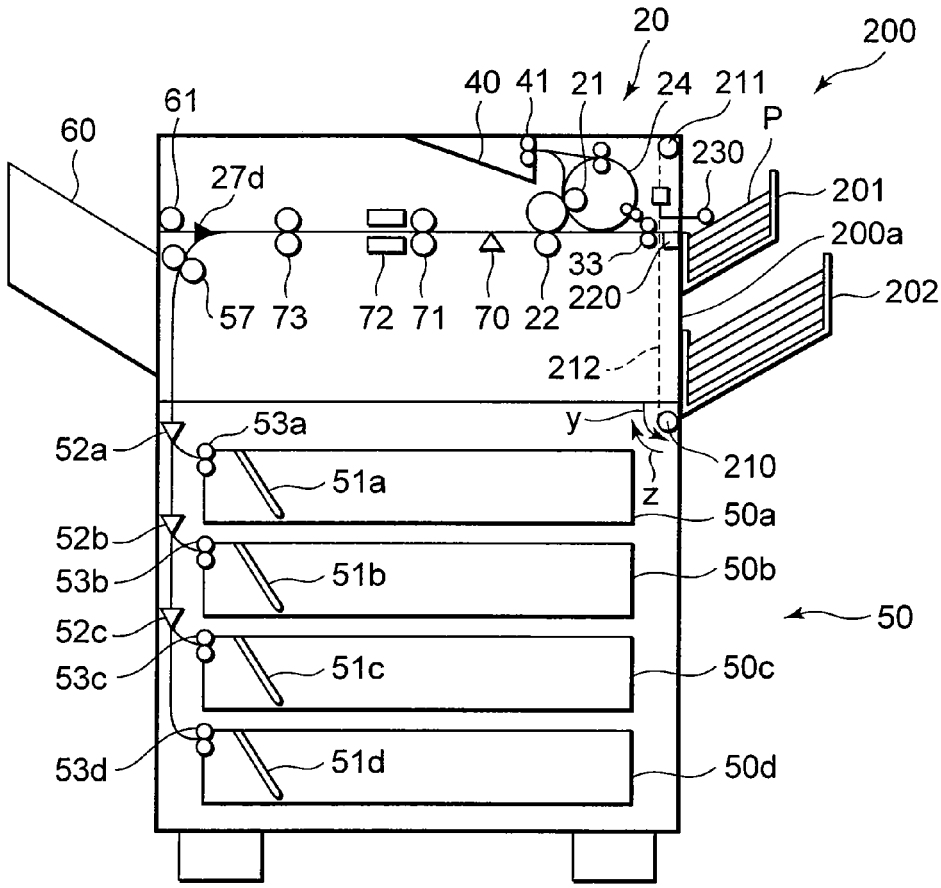
FIG. 19 is a diagram schematically illustrating an image erasing apparatus according to a second embodiment.

In the second embodiment, an image erasing apparatus 200 includes a first supply cassette 201 and a second supply cassette 202 as the support sections, as shown in FIG. 19. The number of supply cassettes is not particularly limited. In advance, for example, the first supply cassette 201 is set to exclusively supply sheets with a size of JIS standard A4 and the second supply cassette 202 is set to exclusively supply sheets with a size of JIS standard A3.

The first supply cassette 201 and the second supply cassette 202 move, for example, in the vertical direction. The first supply cassette 201 or the second supply cassette 202 is made to move to the position of a pickup roller 230 using a timing belt 212 suspended on a driving pulley 210 and an idle pulley 211. The first supply cassette 201 and the second supply cassette 202 may be, for example, fixed. When the first supply cassette 201 and the second supply cassette 202 are fixed, the first supply cassette 201 and the second supply cassette 202 include pickup rollers for picking up a sheet P, respectively, and the image erasing apparatus 200 includes carrying guides carrying the picked-up sheet P to the separation roller pair 33.

Figure 20:
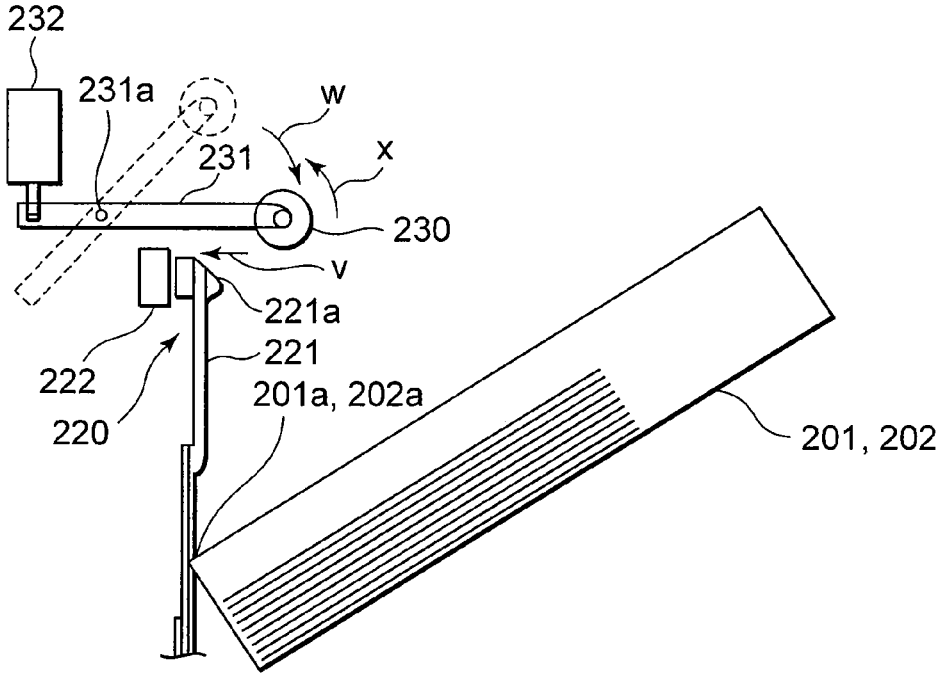
FIG. 20 is a diagram schematically illustrating a configuration of a cassette sensor and a pickup roller according to the second embodiment.

The image erasing apparatus 200 includes a cassette sensor 220 on the side surface 200*a* of the image erasing apparatus 200. As shown in FIG. 20, the cassette sensor 220 includes an actuator 221 and a switch 222. The actuator 221 rotates in the direction of arrow v and comes into contact with the switch 222, when a top end 201*a* or 202*a* of the first supply cassette 201 or the second supply cassette 202 presses a protrusion 221*a*.

The image erasing apparatus 200 includes a rotation lever 231 supporting the pickup roller 230. The rotation lever 231 rotates about a pivot 231*a*. A solenoid 232 supports the lever at the position indicated by a dotted line in FIG. 20 and retreats the pickup roller 230 to the inside of the image erasing apparatus 200, when it is turned off. The solenoid 232 causes the rotation lever 231 to rotate in the direction of arrow w and disposes the pickup roller 230 at a sheet pickup position above the first supply cassette 201 or the second supply cassette 202, when it is turned on.

Figure 21:
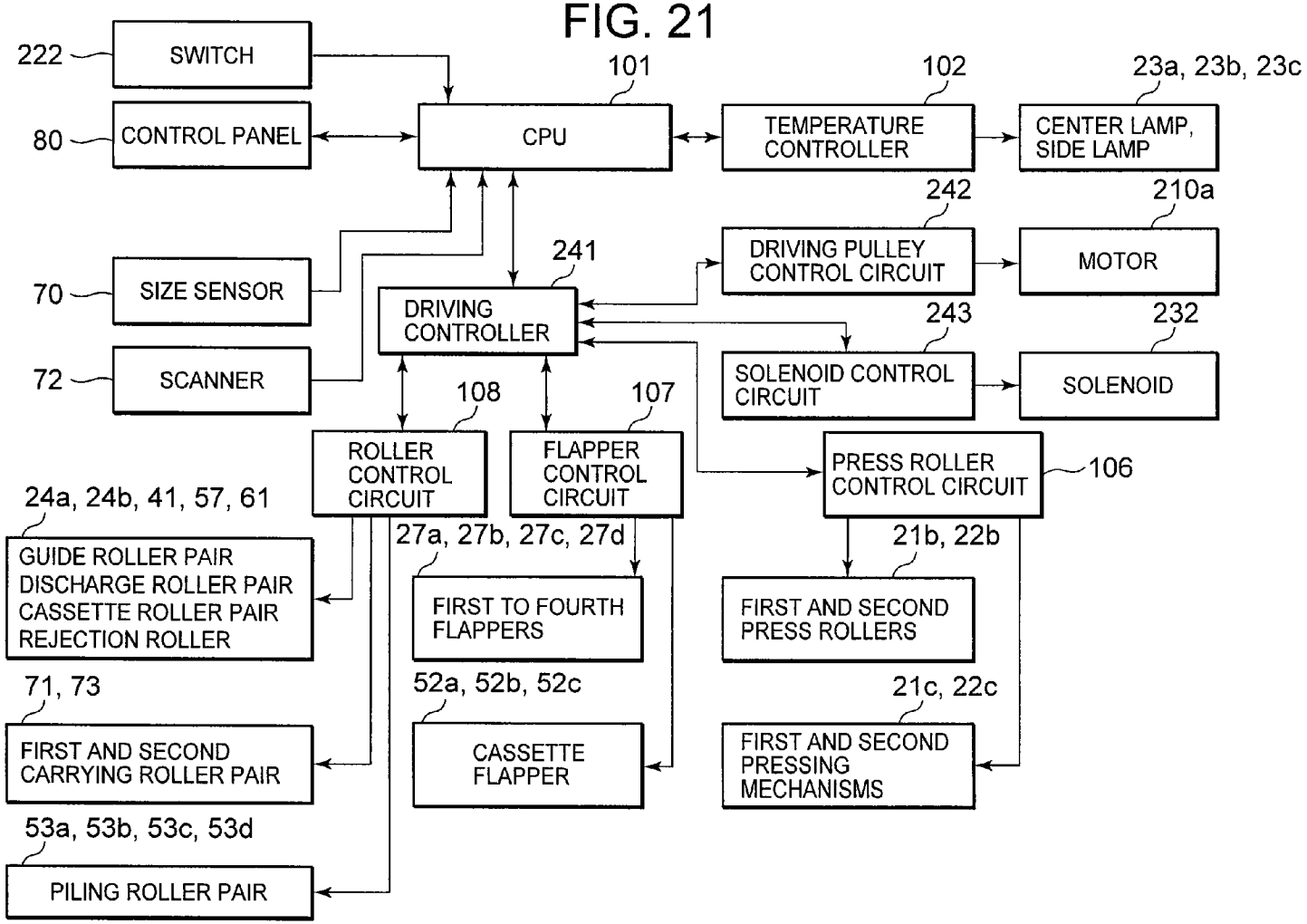
FIG. 21 is a block diagram schematically illustrating a control system according to the second embodiment.

As shown in FIG. 21, a driving controller 241 of a control system 240 controls a press roller control circuit 106, a flapper control circuit 107, a roller control circuit 108, a driving pulley control circuit 242, and a solenoid control circuit 243. The driving pulley control circuit 242 controls the driving of a motor 210*a* of the driving pulley 210 and the solenoid control circuit 243 controls the driving of the solenoid 232. The CPU 101 determines the position of the first supply cassette 201 or the second supply cassette 202 on the basis of the sensing result of the switch 222.

A user places a sheet P from which an image should be erased on the first supply cassette 201 when the size of the sheet P is A4, and places the sheet P on the second supply cassette 202 when the size is A3. For example, when a reuse sheet P of the A3 size is necessary while the first supply cassette 201 and the second supply cassette 202 are located at the position shown in FIG. 19, the user specifies the second supply cassette 202 by the use of the control panel 80. When the image erasing apparatus 200 is erasing a sheet P of the A4 size in the first supply cassette 201, the image erasing apparatus 200 starts erasing the sheet of the A3 size after erasing the image of the sheet P in the course.

When the erasing of the image of the sheet P in the course is finished, the solenoid control circuit 243 turns off the solenoid 232. The solenoid 232 causes the rotation lever 231 in the direction of arrow x and retreats the pickup roller 230 to the inside of the image erasing apparatus 200.

Then, the driving pulley control circuit 242 drives the motor 210*a* and causes the timing belt 212 to rotate in the direction of arrow y. With the rotation of the timing belt 212, the first supply cassette 201 and the second supply cassette 202 move upward on the side surface 200*a* of the image erasing apparatus 200.

Figure 22:
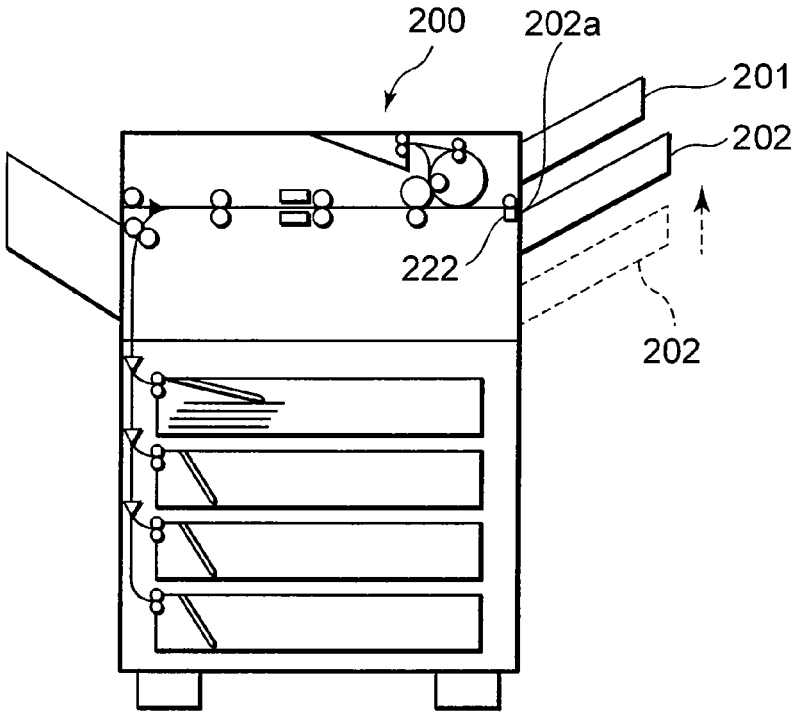
FIG. 22 is a schematic explanatory view illustrating the move upward of a supply cassette according to the second embodiment.

When the second supply cassette 202 reaches the position shown in FIG. 22 and the top end 202*a* of the second supply cassette 202 presses the protrusion 221*a* of the actuator 221, the actuator 221 turns on the switch 222. When the switch 222 is turned on, the CPU 101 stops the motor 210*a*.

For example, similarly to the first embodiment, the user selects a desired image erasing mode or a number of sheets to be erased by the use of the control panel 80 and starts an operation of erasing an image of a sheet P of the A3 size. The solenoid control circuit 234 turns on the solenoid 232 and disposes the pickup roller 230 at the sheet pickup position. The image erasing apparatus 200 picks up the sheet P of the A3 size from the second supply cassette 202 by the use of the pickup roller 230, and erases the image of the sheet P of the A3 size in the image erasing mode.

When images of a predetermined number of sheets P of the A3 size are erased, the solenoid 232 is turned off to retreat the pickup roller 230 to the inside of the image erasing apparatus 200. The user picks up the sheets P of the A3 size from the paper discharge tray 40, the fourth cassette 50*d*, or the third cassette 50*b* and reuses the picked-up sheets. The user can obtain the reuse sheets P of the A3 size prior to the sheets of the A4 size, by selecting the second supply cassette 202.

Then, when the reuse sheets P of the A4 size are necessary, the user specifies the first supply cassettes 201 by the use of the control panel 80. The driving pulley control circuit 242 drives the motor 210*a* and causes the timing belt 212 to rotate in the direction of arrow z. With the rotation of the timing belt 212, the first supply cassette 201 and the second supply cassette 202 move downward on the side surface 200*a* of the image erasing apparatus 200.

When the first supply cassette 201 reaches the position shown in FIG. 19 and the top end 201*a* of the first supply cassette 201 presses the protrusion 221*a* of the actuator 221 to turn on the switch 222, the CPU 101 stops the motor 210*a*. The user selects a necessary image erasing mode or the number of sheets to be erased by the use of the control panel 80, thereby starting the operation of erasing images of the sheets P of the A4 size.

When the erasing operation is finished, the user picks up the sheets P of the A4 size from the paper discharge tray 40, the third cassette 50*c*, or the first cassette 50*a*, and reuses the picked-up sheets. The user can preferentially obtain the reuse sheets P of the A4 size by selecting the first supply cassette 201.

According to the second embodiment, similarly to the first embodiment, it is possible to obtain a reuse sheet at a high speed depending on the user's requirement. It is also possible to obtain a reuse sheet with high quality depending on the user's requirement. It is also possible to easily take out a reuse sheet depending on the user's requirement. In addition, it is possible to erase an image of a sheet having a size specified by the user with priority and to reuse the sheet.

While certain embodiments have been described these embodiments have been presented by way of example only, and are not intended to limit the scope of the inventions. Indeed, the novel apparatus and methods described herein may be embodied in a variety of other forms: furthermore various omissions, substitutions and changes in the form of the apparatus and methods described herein may be made without departing from the spirit of the inventions. The accompanying claims and there equivalents are intended to cover such forms of modifications as would fall within the scope and spirit of the invention.

What is claimed is:

1. An image erasing apparatus comprising:

a first carrying section for carrying a recording medium;

a second carrying section for carrying a recording medium;

a branching section for switching a carrying path of a recording medium between the first carrying section and the second carrying section;

a first erasing section for erasing an image of the recording medium in the first carrying section;

a second erasing section for erasing an image of the recording medium in the second carrying section;

a third carrying section for carrying the recording medium passing through the first erasing section to the branching section; and a control section for controlling the branching section to select the carrying path of the recording medium depending on an image erasing mode.

2. The apparatus of claim 1, wherein the image erasing mode includes a speed-priority mode and a quality-priority mode.

3. The apparatus of claim 2, wherein, when the image erasing mode is in the speed-priority mode, the control section selects as the carrying path of the recording medium a path passing once through one of the first carrying section and the second carrying section.

4. The apparatus of claim 2, wherein, when the image erasing mode is in the quality-priority mode, the control section selects as the carrying path of the recording medium a path passing through the second carrying section via the third carrying section from the first carrying section.

5. The apparatus of claim 2, wherein a carrying direction of the recording medium passing through the third carrying section is switched to the first carrying section or the second carrying section, and when in the quality-priority mode, the control section selects as the carrying path of the recording medium a path passing through the first carrying section via the third carrying section from the first carrying section.

6. The apparatus of claim 1, further comprising:

a detection unit for reading the recording medium; and a determination unit for determining whether the recording medium can be reused from the detection result of the detection unit.

7. The apparatus of claim 6, further comprising a rejection section for recovering the recording medium which is determined to not be reusable from a determination result of the determination unit.

8. The apparatus of claim 1, wherein the first erasing section includes an endless first heating unit and a first pressing unit pressing and contacting the first heating unit, and the second erasing section includes an endless second heating unit and a second pressing unit pressing and contacting the second heating unit.

9. The apparatus of claim 8, wherein the first heating unit is disposed over the first carrying section and the second carrying section and is also used as the second heating unit.

10. The apparatus of claim 1, further comprising an instruction unit for instructing the image erasing mode.

11. The apparatus of claim 1, further comprising:

a first placing section for receiving the recording medium carried from the first carrying section; and a second placing section for receiving the recording medium carried from the second carrying section.

12. The apparatus of claim 11, wherein the first placing section or the second placing section further includes a fullness detect section.

13. The apparatus of claim 1, further comprising a plurality of support sections for supporting the recording medium depending on a type of the recording medium, and for supplying the recording medium to the first carrying section or the second carrying section.

14. The apparatus of claim 13, wherein the type of the recording medium is based on a size of the recording medium.

15. The apparatus of claim 13, wherein the plurality of support sections are configured to move to an entrance of the first carrying section or the second carrying section.

16. The apparatus of claim 15, wherein the plurality of support sections are configured to move to the entrance depending on the size of the recording medium specified by a user.

17. An image erasing method comprising:

setting a number of erasing processes to be performed on a recording medium to one if an image erasing mode is a speed-priority mode;

setting the number of erasing processes to be performed on the recording medium to two or more if the image erasing mode is a quality-priority mode; and performing an erasing process on the recording medium a number of times according to the image erasing mode.

18. The method of claim 17, wherein the erasing process is performed on a first surface of the recording medium and a second surface of the recording medium or the erasing process is repeatedly performed on one surface of the recording medium when the image erasing mode is the quality-priority mode.

19. An image erasing method comprising:

piling recording mediums having an image by size;

specifying the size of a recording medium from which an image should be erased;

selecting a recording medium of which the size is specified from the recording mediums piled by size; and erasing the image of the selected recording medium.

* * * * *